US006174214B1

(12) United States Patent
Cooper

(10) Patent No.: US 6,174,214 B1
(45) Date of Patent: Jan. 16, 2001

(54) FLEXIBLE WATERPROOF FLYING DISC AND METHOD OF MANUFACTURE THEREOF

(75) Inventor: John Scott Cooper, Waikele, HI (US)

(73) Assignee: Coopsort International Ltd., Aiea, HI (US)

( * ) Notice: Under 35 U.S.C. 154(b), the term of this patent shall be extended for 0 days.

(21) Appl. No.: 09/154,106

(22) Filed: Sep. 16, 1998

(51) Int. Cl.[7] ..... A63H 27/00
(52) U.S. Cl. ..... 446/46; 473/588
(58) Field of Search ..... 446/46, 61, 486, 446/490; 473/588

(56) References Cited

U.S. PATENT DOCUMENTS 3,710,505 * 1/1973 Linenfelser ..... 473/588
4,241,533 * 12/1980 Newsome ..... 446/46
4,253,672 * 3/1981 Milzoff et al. ..... 474/588
4,279,097 * 7/1981 Walker ..... 446/46
4,290,226 * 9/1981 Stauffer ..... 446/46
5,026,054 * 6/1991 Osher et al. ..... 446/491
5,116,275 * 5/1992 Sassak ..... 446/48
5,484,159 * 1/1996 Dean et al. ..... 446/46
5,540,610 * 7/1996 Sneddon ..... 446/46

* cited by examiner

*Primary Examiner*—Jacob K. Ackun
*Assistant Examiner*—Jeffrey D. Carlson
(74) *Attorney, Agent, or Firm*—Adams & Wilks

(57) ABSTRACT

A flexible waterproof flying disc comprises a generally disc-shaped body terminating at its periphery in a downwardly extending rim. The body and the rim define a substantially convex upper surface and a substantially concave lower surface. The body has a core formed from a single piece of flexible, close, water-impervious cellular material and has at least one binding strip connected to and around a peripheral edge of the core for imparting a prestressed curvature to the core to define the convex and concave upper and lower surfaces, respectively.

31 Claims, 2 Drawing Sheets

FLEXIBLE WATERPROOF FLYING DISC AND METHOD OF MANUFACTURE THEREOF

BACKGROUND OF THE INVENTION

1. Field of the Invention

The present invention relates generally to recreational flying discs and, more particularly, to a flexible waterproof flying disc for use in wet environments as an aerial projectile during training or informal play and/or as an advertising device. The present invention also relates to a method of manufacturing the flexible waterproof flying disc.

2. Background of the Invention

Flying discs are used in recreational activities, the most common being the game of throw and catch. Conventional flying discs developed for this purpose are generally fabricated from a rigid material such as plastic or a hard rubber material. An inherent disadvantage of plastic or hard rubber flying discs is that, when hurled through the air, the flying disc becomes a rather dangerous missile. Usually no protective equipment is available for the game participants, and it is not infrequent that players will be injured during play due to being hit by the flying disc. For instance, if one of the game participants fails to catch the disc, bodily injury could occur, e.g., as a result of impact to and around the neck and face. Furthermore, since such games are usually played near crowds and in confined areas, an unwary bystander could accidentally be struck in the head or elsewhere because of an errant flight projectory.

Poor weather often forces the game of throw and catch indoors. The risk of property damage in confined indoor areas from flying discs fabricated from a rigid material has largely relegated the participants to other recreational activities. Window breakage, abrasion and scuffing of floors and breakage of light fixtures and other fragile household articles are likely to occur when flying discs fabricated from a rigid material are used indoors.

Moreover, during training of small children in the game of throw and catch, fundamentals are oftentimes not properly learned due to the fear associated with a rigid flying disc. Actual injuries and the fear thereof have a profound impact on the ability of young children to relax and concentrate on the game of throw and catch. In numerous instances, the potential risk of being hit by a thrown rigid flying disc leads many young children to shun the game of throw and catch.

Prior attempts have been made to provide a safe, high performance, durable flying disc. One extremely soft, plastic foam flying disc has been provided. Such a conventional flying disc, however, being formed of open cell foams, is extremely light in weight and has unrealistic dynamic characteristics. In addition, plastic foam discs are rather flimsy and absorbent of moisture and, therefore, inappropriate for use in wet environments, such as in a pool, at the beach or in the rain. Upon contact with water, conventional flying discs of this type tend to become stiff and heavy, which adversely affects the flexibility and usability of the flying disc. Additionally, such conventional flying discs are unable to effectively protect the interior thereof against moisture absorption.

Other attempts to provide safe, high performance, durable recreational flying discs have resulted in flying discs which are readily distortable, easily affected by water and rather easily destructible. Such flying discs also do not have truly aerodynamic characteristics and are, therefore, deficient in flight duration and stability, flight performance and hovering ability.

The present invention overcomes many of the disadvantages inherent in conventional flying discs used in wet environments and/or during training or informal play.

SUMMARY OF THE INVENTION

It is an object of the present invention to provide a flexible waterproof flying disc which resists the absorption of water and which may be used in wet environments without damaging the disc or adversely affecting the flexibility and usability of the disc and which will retain its shape during prolonged and repeated use.

It is another object of the present invention to provide a flexible waterproof flying disc that is lightweight, durable in strength, rugged in construction, foldable for carrying in a pocket, and which can be stretched out of its original shape.

It is another object of the present invention to provide a durable flexible waterproof flying disc for play and training which is constructed so as to substantially reduce the risk of injury to players and physical damage to property.

It is another object of the present invention to provide a flexible waterproof flying disc which has superior aerodynamic characteristics including flight duration and stability, glide performance and hovering ability.

It is another object of the present invention to provide a flexible waterproof flying disc which is easy and economical to manufacture.

It is still another object of the present invention to provide an advertising device comprising a flexible waterproof flying disc having a fabric covering which can be imprinted with selected indicia so that the device can be used as an advertising device.

The foregoing and other objects of the present invention are carried out by a flexible waterproof flying disc comprising a generally disc-shaped body terminating at its periphery in a downwardly extending rim. The body and the rim define a substantially convex upper surface and a substantially concave lower surface. The body has a core formed from a single piece of flexible, non-porous, water-impervious cellular material and at least one binding strip connected to and around a peripheral edge of the core.

Preferably, the single piece of flexible, non-porous, water-impervious material comprises synthetic rubber. Preferably, the synthetic rubber comprises closed-cell neoprene.

The at least one binding strip preferably comprises a first binding strip sewn to and around the peripheral edge of the core along a first stitch line, and a second binding strip sewn to and around the peripheral edge of the core along a second stitch line and overlapping the first binding strip in direct contact therewith.

Preferably, a fabric layer is bonded on at least one of the upper and lower surfaces of the circular section.

In another aspect, the present invention is directed to a method of manufacturing a flying disc comprising the steps of forming a generally circular core from a single piece of flexible, non-porous, water-impervious material, and securing a first binding strip and a second binding strip around a peripheral edge of the core to impart a prestressed curvature to the core to define a substantially convex upper surface and a substantially concave lower surface of the core. Preferably, the single piece of flexible, non-porous, water-impervious material comprises synthetic rubber, such as closed-cell neoprene.

In another aspect, the present invention is directed to an advertising device comprising a generally disc-shaped core formed from a single piece of flexible, non-porous, water-impervious material and having a first surface and a second surface opposite the first surface. A generally disc-shaped fabric layer is disposed on one of the first and second surfaces of the core and contains thereon printed indicia. A first binding strip is sewn to and around the peripheral edge of the core along a first stitch line. A second binding strip is sewn to and around the peripheral edge of the core along a second stitch line and overlaps the first binding strip in direct contact therewith. The first and second stitch lines and the first and second binding strips impart a prestressed curvature to the core to provide the first and second surfaces with generally convex and concave shapes, respectively.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENT

Figure 1:
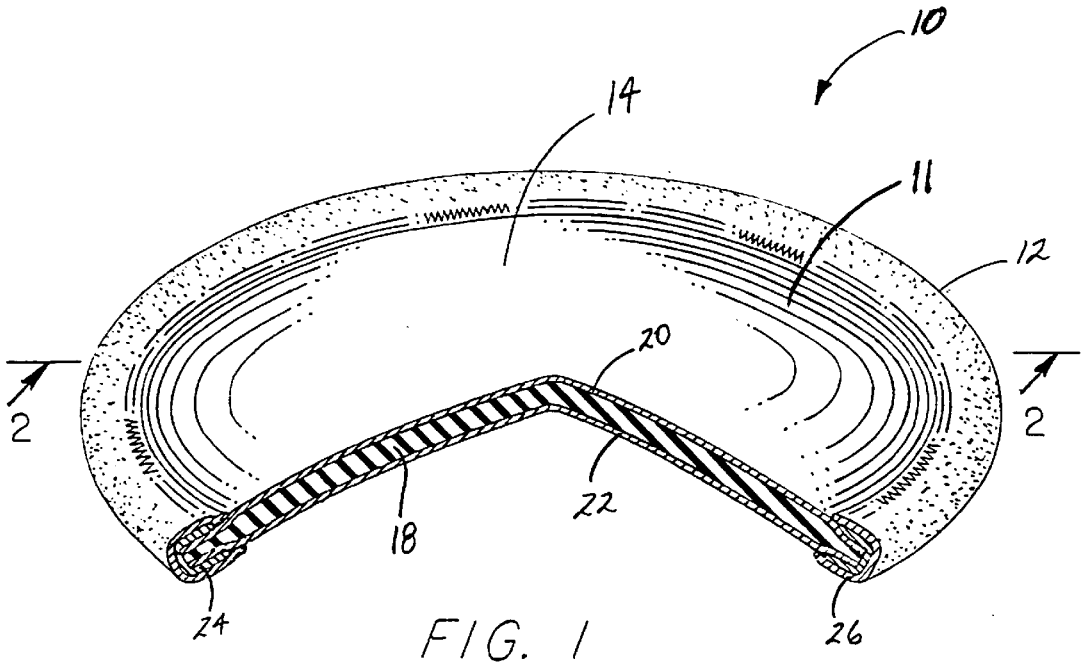
FIG. 1 is a perspective view of a flexible waterproof flying disc according to the present invention with a segment cut away to expose a non-porous, water-impervious core, fabric layers, and binding strips.

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

Referring now to the drawings in detail, wherein like numerals are used to indicate like elements throughout, there is shown in FIGS. 1–4 an embodiment of a flexible waterproof flying disc 10 according to the present invention. The flying disc 10 comprises a substantially disc- or circular-shaped body, generally designated at 11, terminating at its periphery in a downwardly extending rim 12. The body 11 and the rim 12 define a substantially convex upper surface 14 and a substantially concave lower surface 16. By this construction, the flying disc 10 has a curved airfoil configuration whose concave lower surface 16 forms an air pocket for improved aerodynamic performance during flight when the flying disc is used as an aerial projectile.

The flying disc 10 is constructed with a central, generally circular section or generally disc-shaped core 18 preferably formed from a single piece of resilient, non-porous, water-impervious material. Upper and lower surfaces of the core 18, corresponding to the upper and lower surfaces 14, 16 of the body 11, are covered by fabric layers 20, 22, respectively, which conform to the shape of the core. A first binding strip 24 and a second binding strip 26 are sewn around a peripheral edge 28 of the core 18 along first and second stitch lines defined by stitches 30, 32, respectively, which impart a prestressed curvature or bow to the core 18.

The core 18 preferably comprises a single piece of nonporous synthetic rubber cellular material which is impervious to water, such as closed-cell neoprene. Closed-cell neoprene not only exhibits excellent waterproof properties due to its non-absorbent characteristic, but also has a desirable flexible property which permits it to be repeatedly elastically deformed without damage or permanent deformation while providing the necessary structural integrity for shape retention so that the flying disc can be used as an aerial projectile. The flexible nature of neoprene also functions to absorb shock upon impact and thus provides an inherent safety factor. The use of a flexible material such as neoprene for the core 18 of the flying disc 10 is further advantageous in that the flying disc can be folded for carrying in a pocket or the like, and can be stretched and distorted out of its curved, airfoil configuration, such as when playing with a dog gripping the flying disc. When released, the stretched flying disc will spring back to its natural shape and will readily assume its original curved, airfoil configuration.

Neoprene is also highly resistant to weather and sunlight due to its extremely low rate of oxidation. Thus the use of closed-cell neoprene for the core 18 allows effective use of the flying disc 10 in various outdoor and indoor environments without affecting its flexibility and useability, including long exposures to sunlight and in wet environments such as in a pool, the beach or in the rain.

The fabric layers 20, 22 are preferably formed from thin layers of nylon which are preferably bonded to the upper and lower surfaces of the core 18. During use of the flying disc 10 in wet environments, the thin nylon layers protect the core 18 and retain some moisture to give the flying disc sufficient weight to provide the flying disc with realistic dynamic characteristics, such as stability, improved flight performance and improved handling. Additionally, the properties of nylon enable the retained moisture to be sprayed during flight of the flying disc. This feature provides an aesthetic display during flight of the flying disc as well as further improving its flight performance. Nylon is also a tough, lightweight material which is difficult to tear and can be easily cleaned. Thus the properties of nylon allow the flying disc 10 to be used in wet environments without damaging the flying disc or adversely affecting its flexibility and/or useability. Other suitable materials for the fabric layers 20, 22 which exhibit the above properties include, but are not limited to, LYCRA, polyester, fleece and polypropylene.

Figure 2:
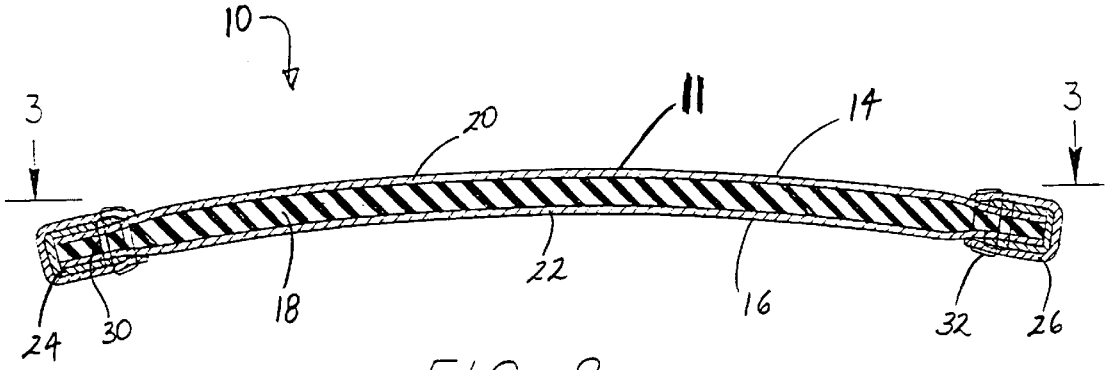
FIG. 2 is a cross-sectional view taken along line 2—2 of FIG. 1.
Figure 4:
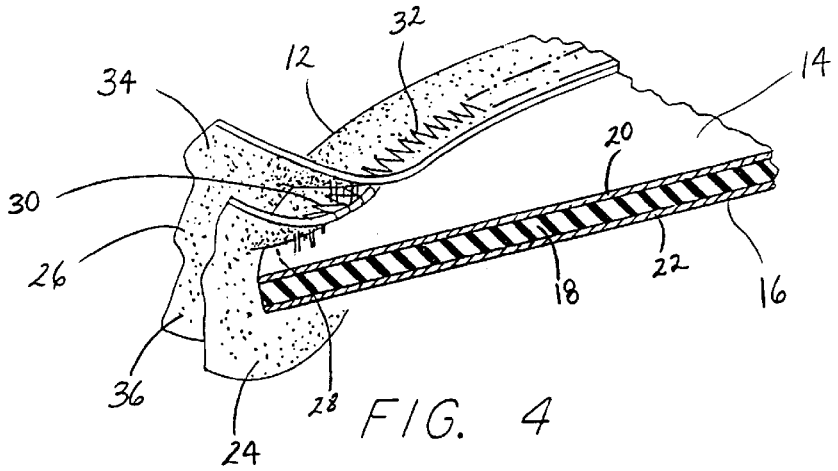
FIG. 4 is a perspective view to an enlarged scale taken along line 4—4 of FIG. 1.

As shown in FIGS. 1, 2 and 4, the binding strip 24 is disposed around the peripheral edge 28 of the core 18 and overlaps the fabric layers 20, 22 in direct contact therewith at the upper and lower surfaces of the core 18. The first stitches 30 extend through the binding strip 24, the fabric layers 20, 22 and the core 18. The binding strip 26 is disposed around the peripheral edge 28 of the core 18 and overlaps the binding strip 24 in direct contact therewith at the upper and lower surfaces of the core 18. The second stitches 32 extend through the binding strip 26, the binding strip 24, the fabric layers 20, 22 and the core 18. Preferably, the binding strip 26 has a larger width than the binding strip 24 such that the binding strip 26 completely overlaps the binding strip 24 so that opposite lateral edges 34, 36 of the binding strip 26 are sewn directly on the fabric layers 20, 22, respectively, by the second stitches 32. For example, a width of 1.0 inch and a width of 1.5 inches are suitable for the binding strips 24, 26, respectively. However, it will be appreciated by those of ordinary skill in the art that other combinations of widths are suitable for the binding strips 24, 26 so long as the binding strip 26 completely overlaps the binding strip 24 on the upper and lower surfaces of the core 18 as shown in FIGS. 1 and 2.

The binding strips 24, 26 are preferably formed from nylon webbing material which, as described above, is a tough, lightweight material which is difficult to tear and can be easily cleaned. The nylon binding strips 24, 26 will also retain some moisture during use of the flying disc 10 in wet environments to give the flying disc some weight, which is uniformly distributed around the peripheral edge 28 of the core 18 to further enhance the stability, flight performance and handling of the flying disc. The use of a nylon webbing material for the binding strips 24, 26 also provides for an enhanced gripping surface to aid in throwing the flying disc 10. Other suitable materials for the binding strips 26, 26 include, but are not limited to, LYCRA, polyester, fleece and polypropylene.

A preferred method of manufacturing the flexible waterproof flying disc 10 according to the present invention will next be described.

The core 18 is first cut from a suitable non-porous, water-impervious synthetic rubber material, such as closed-cell neoprene, either manually or with an industrial cutting machine, using a generally circular-shaped pattern. The fabric layers 20, 22 are cut in a similar manner from nylon, LYCRA, polyester, polypropylene or the like and then bonded to the upper and lower surfaces, respectively, of the core 18 by, for example, a conventional heat bonding process. Alternatively, the fabric layers 20, 22 are bonded to the upper and lower surfaces of the core 18 prior to the foregoing cutting step, and then the core with the fabric layers bonded thereon are cut simultaneously using a generally circular-shaped pattern. The binding strips 24, 26 are also cut by hand or with an industrial cutting machine into linear strips of, for example, approximately 1 inch and 1.5 inches in width, respectively, from nylon, LYCRA, polyester, fleece, polypropylene or other suitable material.

The binding strip 24 is then positioned around the peripheral edge 28 of the core 18 so that the binding strip 24 overlaps the fabric layers 20, 22 in direct contact therewith. The binding strip 24 and the core 18 are then sewn together along the first stitch line using, for example, an industrial sewing machine so that the first stitches 16 extend through the binding strip 24, the fabric layers 20, 22 and the core 18 to form a first generally circular-shaped seam. The binding strip 26 is then disposed around the peripheral edge 28 of the core 18 so as to completely overlap the binding strip 24 in direct contact therewith. At this time, tension is applied to the lateral edges 34, 36 of the binding strip 26, and the lateral edges 34, 36 are positioned directly on the fabric layers 20, 22, respectively. The binding strip 26 and the core 18 are then sewn together along the second stitch line so that the second stitches 32 extend through the binding strip 26, the binding strip 24, the fabric layers 20, 22 and the core 18 to form a second generally circular-shaped seam concentric to the first seam and disposed closer to the center of the core 18 than the first seam.

The stitches 30, 32 defining the first and second generally circular-shaped seams impart internal stresses to the core 18 which urge the peripheral edge portion 28 and surrounding material of the core 18 downwardly to form a curved contour as shown in FIG. 2. The binding strips 24, 26 also function to compress and impart curvature to the core 18. By this construction, the flexible waterproof flying disc has superior aerodynamic characteristics including flight duration and stability, glide performance and hovering ability.

In the embodiment of the flying disc 10 disclosed in FIGS. 1–4, the first and second fabric layers 20, 22 are preferably bonded to the upper and lower surfaces of the core 18 prior to the sewing process. However, it will be appreciated by those of ordinary skill in the art that other methods of securing the fabric layers 20, 22 to the surfaces of the core 18 are suitable. For example, the fabric layers 20, 22 conforming to the shape of the core 18 can be placed adjacent the upper and lower surfaces of core, respectively, and then the fabric layers can be sewn to the core along the peripheral edge 28 thereof. The binding strips 24, 26 can then be sewn to the core 18 in the manner described above. Alternatively, the fabric layers 20, 22 and the binding strips 24, 26 can be sewn to the core 18 simultaneously in a single sewing process.

It will also be appreciated by those of ordinary skill in the art that the construction of the flying disc 10 can be modified by bonding or sewing a fabric layer on only one of the upper and lower surfaces of the core 18, or by fabricating the flying disc without the fabric layers.

Figure 3:
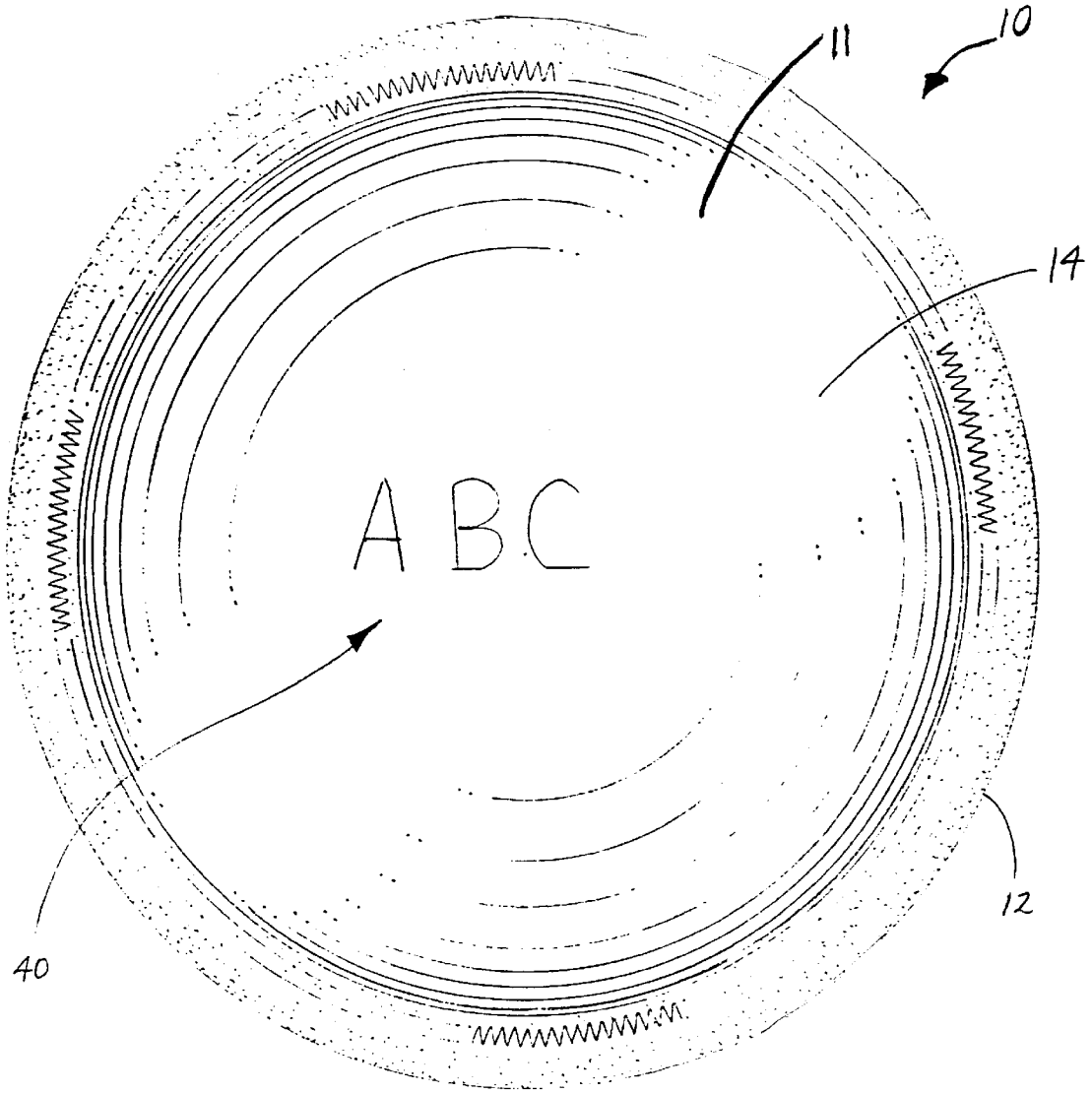
FIG. 3 is a top elevational view taken along line 3—3 of FIG. 2.

Although described above with a specific application to an aerial projectile, the flying disc 10 of the present invention is also applicable as an advertising device. For example, as shown in FIG. 3, the fabric layer 20 can be imprinted or embroidered with decorative designs or advertising indicia 40, such as a company name or logo, an advertising message, by using, for example, a printing or an embroidering process prior or subsequent to bonding the fabric layers to the core 18 or the sewing process as set forth above. Alternatively, both of the fabric layers 20, 22 can be imprinted with the decorative designs or the advertising message 40. Furthermore, instead of imprinting or embroiding indicia, one or more decals containing indicia may be attached to one or both of the fabric layers 20, 22. The visual representations add desired decorative and aesthetic effects to the flying disc for attracting attention, which is particularly advantageous when the flying disc is used as an advertising or promotional item.

It will be appreciated by those skilled in the art that the flying disc according to the present invention may be used as an aerial projectile during informal play near crowds or indoors without the risk of injury to players, physical damage to property or other inherent risks associated with rigid flying discs. For example, the flying disc may be used for play by adults and children as a retrieval toy for animals, particularly dogs. The flying disc is characterized by having an aerodynamic design for long and stable flight similar to rigid discs, yet is made of soft, flexible material which eliminates harm to humans and damage to the mouth of any animal catching it. Also, because the flying disc of the present invention is flexible, when the flying disc is lying on a flat surface, it can be easily picked up and retrieved by a dog, as compared to a hard plastic disc which is often difficult for a dog to pick up on his own. The flying disc of the present invention is also well suited as a training tool for learning the fundamentals of the game of throw and catch adequately and at a quicker rate.

By constructing the flying disc according to the present invention using a resilient core formed from a single piece of non-porous, water-impervious material, such as closed-cell neoprene, the flying disc is particularly well adapted for use in wet environments without damaging the flying disc or adversely affecting the flexibility and useability of the flying disc. Furthermore, the flying disc according to the present invention is light in weight, will retain its shape during prolonged and repeated use, is rugged and durable in construction, and may be manufactured easily and at a low cost.

Moreover, when the flying disc according to the present invention is fabricated with a fabric layer disposed on the upper and/or lower surface of the flying disc, a suitable medium is provided for receiving selected indicia so that the flying disc can be used as an advertising or promotional device.

From the foregoing description, it can be seen that the present invention comprises an improved flexible waterproof flying disc. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. A flexible waterproof flying disc comprising: a generally disc-shaped body terminating at its periphery in a downwardly extending rim, the body and the rim defining a substantially convex upper surface and a substantially concave lower surface, the body having a core formed from a single piece of flexible, closed-cell, water-impervious cellular material and having a first binding strip and a second binding strip each connected to and extending around a peripheral edge of the core; wherein the first binding strip is sewn to and around the peripheral edge of the core along a first stitch line, and the second binding strip is sewn to and around the peripheral edge of the core along a second stitch line and overlaps the first binding strip in direct contact therewith.

2. A flexible waterproof flying disc according to claim 1; wherein the single piece of flexible, closed-cell, water-impervious cellular material comprises closed-cell synthetic rubber.

3. A flexible waterproof flying disc according to claim 2; wherein the closed-cell synthetic rubber comprises closed-cell neoprene.

4. A flexible waterproof flying disc according to claim 1; wherein the binding strip is comprised of nylon.

5. A flexible waterproof flying disc according to claim 1; wherein the binding strip is sewn to the core along a stitch line around the peripheral edge of the core to define the substantially convex upper surface and the substantially concave lower surface of the body.

6. A flexible waterproof flying disc according to claim 1; wherein the core has upper and lower surfaces corresponding to the upper and lower surfaces of the body; and wherein the body has a fabric layer bonded on at least one of the upper and lower surfaces of the core.

7. A flexible waterproof flying disc according to claim 6; wherein the fabric layer is comprised of nylon.

8. A flexible waterproof flying disc according to claim 1; further comprising indicia disposed on the fabric layer.

9. A flexible waterproof flying disc according to claim 1; wherein the first and second binding strips are formed from nylon.

10. A flexible waterproof flying disc comprising: a central, generally circular section defining a peripheral edge and formed from a single piece of flexible, closed-cell, water-impervious cellular material; stitching means disposed around the peripheral edge of the circular section for internally stressing the circular section to impart a prestressed curvature to the circular section defining a substantially convex upper surface and a substantially concave lower surface, the stitching means comprising a plurality of first stitches defining a first generally circular stitch line and a plurality of second stitches defining a second generally circular stitch line; a first binding strip sewn to and around the peripheral edge of the circular section along the first stitch line; and a second binding strip sewn to and around the peripheral edge of the circular section and overlapping the first binding strip in direct contact therewith.

11. A flexible waterproof flying disc according to claim 10; wherein the single piece of flexible, closed-cell, water-impervious cellular material comprises closed-cell synthetic rubber.

12. A flexible waterproof flying disc according to claim 11; wherein the closed-cell synthetic rubber comprises closed-cell neoprene.

13. A flexible waterproof flying disc according to claim 10; wherein the first and second binding strips are comprised of nylon.

14. A flexible waterproof flying disc according to claim 10; further comprising a fabric layer bonded on at least one of the upper and lower surfaces of the circular section.

15. A flexible waterproof flying disc according to claim 14; further comprising indicia disposed on the fabric layer.

16. A flexible waterproof flying disc according to claim 14; wherein the fabric layer is comprised of nylon.

17. A flexible waterproof flying disc comprising: a generally disc-shaped core formed from a second piece of flexible, closed-cell, water-impervious cellular material and having a first surface and a second surface opposite the first surface; a generally disc-shaped fabric layer disposed on one of the first and second suction of the core; a first binding strip sewn to and around the peripheral edge of the core along a first stitch line; and second binding strip sewn to and around the peripheral edge around the core along a second stitch and overlapping the first binding strip in direct contact therewith; wherein the first and second stitch lines and the first and second binding strips impart a prestressed curvature to the core to provide the first and second surfaces with generally convex and concave shapes, respectively.

18. A flexible waterproof flying disc according to claim 17; wherein the single piece of flexible closed-cell, water-impervious cellular mate comprises closed-cell synthetic rubber.

19. A flexible waterproof flying disc according to claim 18; wherein the closed-cell synthetic rubber comprises closed-cell neoprene.

20. A flexible waterproof flying disc according to claim 19; wherein the first and second binding strips are comprised of nylon.

21. A flexible waterproof flying disc according to claim 17; wherein the fabric layer is bonded to the first or second surface of the core.

22. A flexible waterproof flying disc according to claim 17; wherein the fabric layer is comprised of nylon.

23. A method of manufacturing a flying disc, comprising the steps of: forming a generally circular core from a single piece of flexible, closed-cell, water-impervious cellular material; and securing a first binding strip and a second binding strip around a peripheral edge of the core to impart a prestressed curvature to the core to define a substantially convex upper surface and a substantially concave lower surface of the core; wherein the securing step comprises sewing the first binding strip to and around the peripheral edge of the core along a first stitch line, and thereafter sewing the second binding strip to and around the peripheral edge of the core along a second stitch line such that the second binding strip overlays the first binding strip in direct contact therewith.

24. A method of manufacturing a flying disc according to claim 23; wherein the single piece of flexible, closed-cell, water-impervious material comprises closed-cell synthetic rubber.

25. A method of manufacturing a flying disc according to claim 24; wherein the closed-cell synthetic rubber comprises closed-cell neoprene.

26. A method of manufacturing a flying disc according to claim 25; wherein the first and second binding strips are comprised of nylon.

27. A method of manufacturing a flying disc according to claim 23; including the step of bonding a fabric layer on at least one of the upper and lower surfaces of the core prior to the securing step.

28. A method of manufacturing a flying disc according to claim 27; wherein the fabric layer comprises nylon.

29. An advertising device comprising: a generally disc-shaped core formed from a single piece of flexible, closed-cell, water-impervious cellular material and having a first surface and a second surface opposite the first surface; a generally disc-shaped fabric layer disposed on one of the first and second surfaces of the core; advertising indicia disposed on the fabric layer; a first binding strip sewn to and around the peripheral edge of the core along a first stitch line; and a second binding strip sewn to and around the peripheral edge of the core along a second stitch line and overlapping the first binding strip in direct contact therewith; wherein the first and second stitch lines and the first and second binding strips impart a prestressed curvature to the core to provide the first and second surfaces with generally convex and concave shapes, respectively.

30. An advertising device according to claim 29; wherein the single piece of flexible, closed-cell, water-impervious cellular material comprises closed-cell synthetic rubber.

31. An advertising device according to claim 30; wherein the closed-cell synthetic rubber comprises closed-cell neoprene.

* * * * *